United States Patent [19]

Gerber

[11] Patent Number: 4,864,688

[45] Date of Patent: Sep. 12, 1989

[54] HINGE HAVING VARIED HEIGHT OFFSET LEAFS

[76] Inventor: Mary E. Gerber, 651 N. Fairfax Ave., Los Angeles, Calif. 90036

[21] Appl. No.: 155,246

[22] Filed: May 23, 1988

[51] Int. Cl.[4] ..... E05D 7/10; E05D 5/06

[52] U.S. Cl. ..... 16/261; 16/382; 16/390; 16/DIG. 29

[58] Field of Search ..... 16/252, 261, 262, 382, 16/386, 387, 389, 390, 391, 392, DIG. 29, DIG. 40

[56] References Cited

U.S. PATENT DOCUMENTS

| | | | |
|---|---|---|---|
| 382,860 | 5/1888 | Beer | 16/389 |
| 1,429,527 | 9/1922 | Paul | 16/389 |

FOREIGN PATENT DOCUMENTS

| | | | |
|---|---|---|---|
| 149646 | 12/1931 | Switzerland | 16/391 |
| 1014697 | 12/1965 | United Kingdom | 16/390 |

*Primary Examiner*—Fred A. Silverberg
*Attorney, Agent, or Firm*—John E. Wagner

[57] ABSTRACT

A hinge structure includes two sections, each of which incorporates a flange structure attached to a cylindrical pin holding part. The pin is secured in one of the cylindrical parts and the other cylindrical part removably receives the pin. The flange structures for attaching the hinge to a door and to a door jamb include parts of L-shaped cross section extending tangentially from the cylindrical parts with the attaching flanges either forming part of the outboard section or forming part of an additional L-shaped part attached to the outboard edges of the first L-shaped parts. One embodiment includes an additional bend for attachment to a grooved or notched door jamb. Another embodiment includes an elongated rod with eyebolts affixed in grooves near its ends for attachment to a jamb and having flanges located adjacent the eyebolts for attachment to the door. This embodiment leaves the decorated rod exposed along the height of the door.

8 Claims, 3 Drawing Sheets

FIG. 5
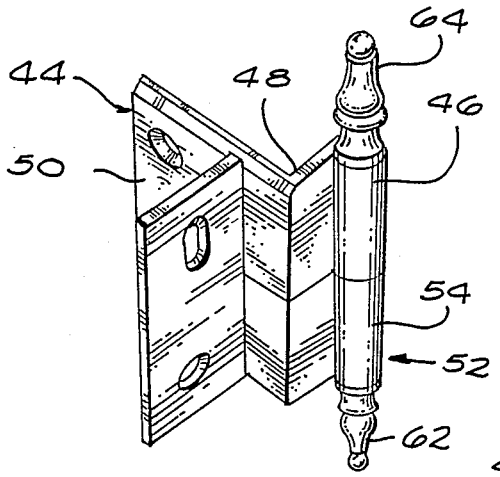
FIG. 7
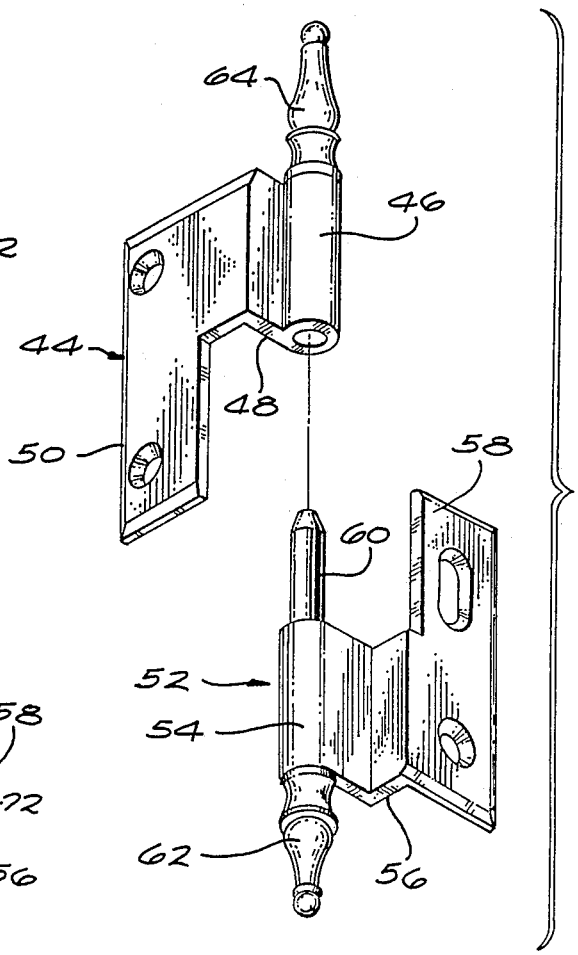
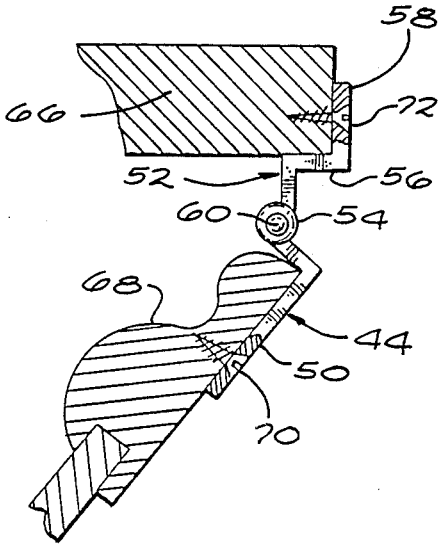
FIG. 6

FIG. 8
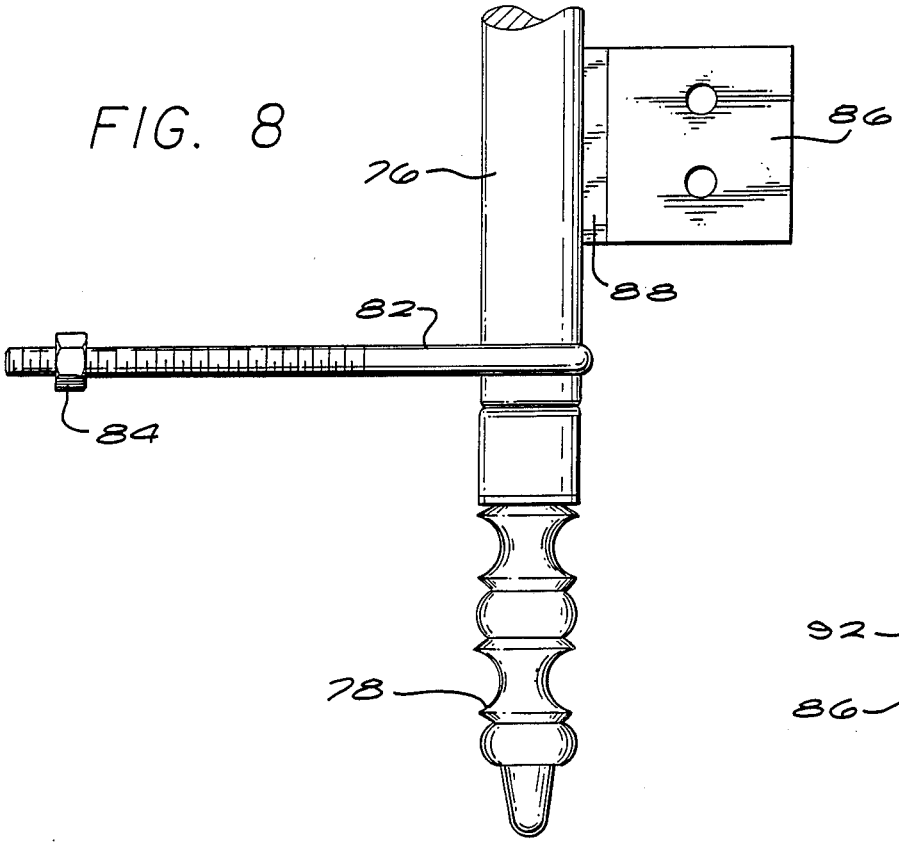
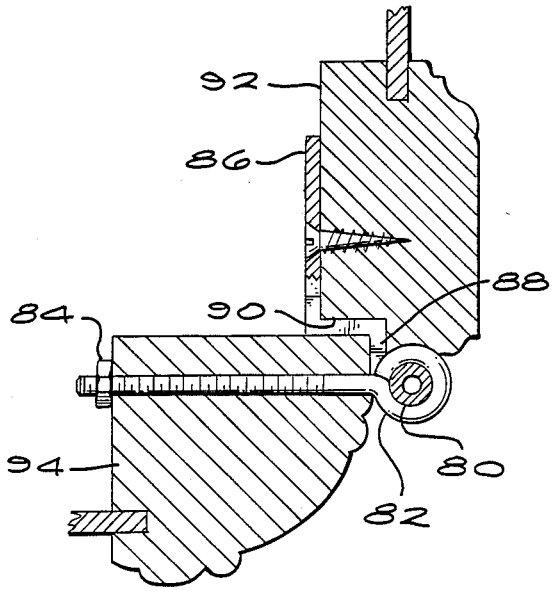
FIG. 9
FIG. 10
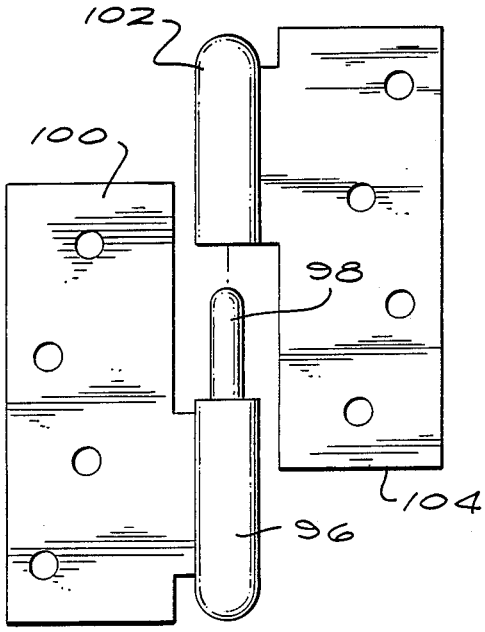
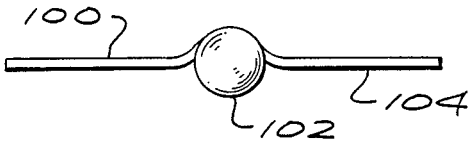
FIG. 11

HINGE HAVING VARIED HEIGHT OFFSET LEAFS

SUMMARY OF THE INVENTION

This invention relates to a hinge assembly and more particularly to a hinge assembly having application for use in cabinets and the like where such hinges need to be both functional and aesthetically pleasing.

In one embodiment of my invention the hinge structure is formed of two sections with a separate cylindrical pin holding part in each section and with the attaching flanges tangentially attached to the cylindrical posts. The attaching flanges which attach to the door and to the door jamb are offset from the tangential position by means of parts of L-shaped cross section. Fastened to the outboard edges of these parts are the screw holding flanges. In one embodiment which is designed for attachment to a door having a longitudinal groove or offset, a double L-shaped flange structure is employed to provide a hinge which is almost entirely invisible when the door is closed except for the cylindrical pin holding parts. Another embodiment includes an elongated decorative rod having a finial at each end and which includes a pair of grooves holding an eyebolt for attachment to a door jamb. Inboard of the eyebolt and groove are a pair of flats to which are fastened offset mounting flanges for attachment to a cabinet door. In some embodiments the cylindrical parts and the pin are arranged so that the door may be easily removed if desired by simply lifting the door off of the pin of the corresponding cylindrical part attached to the door jamb.

BRIEF DESCRIPTION OF THE DRAWINGS

FIG. 5 is a perspective view of a hinge structure incorporating another embodiment of my invention;

FIG. 6 is a view, partly in section, of the hinge of FIG. 5 as attached to a door and door jamb;

FIG. 7 is an exploded perspective view of the hinge of FIGS. 5 and 6;

FIG. 8 is a partial plan view of a hinge structure incorporating still another embodiment of my invention;

FIG. 9 is a view, partly in section, of the hinge of FIG. 8 as attached to a door and door jamb;

FIG. 10 is a plan view of a hinge structure incorporating a further embodiment of my invention; and FIG. 11 is a top view of the hinge of FIG. 10.

DETAILED DESCRIPTION OF THE INVENTION

Figure 1:
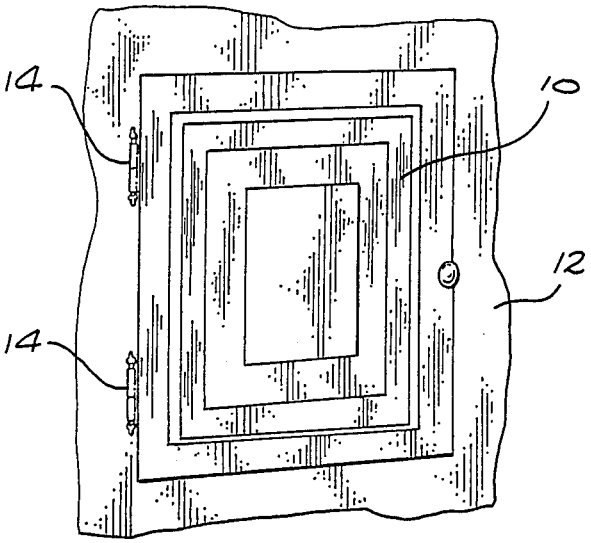
FIG. 1 is a front view of a typical cabinet door situated in a cabinet wall with hinges according to my invention.
Figure 2:
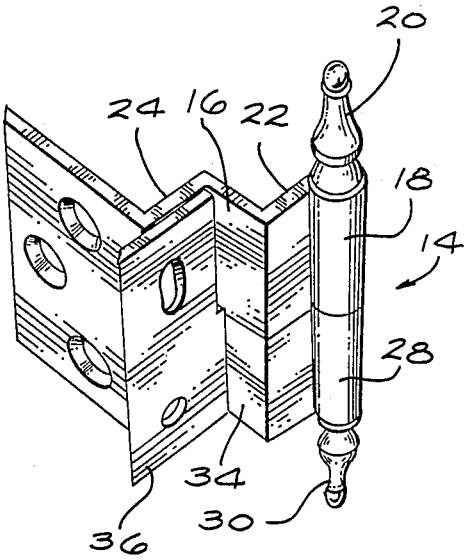
FIG. 2 is a perspective view of a hinge structure showing one embodiment of the invention.
Figure 3:
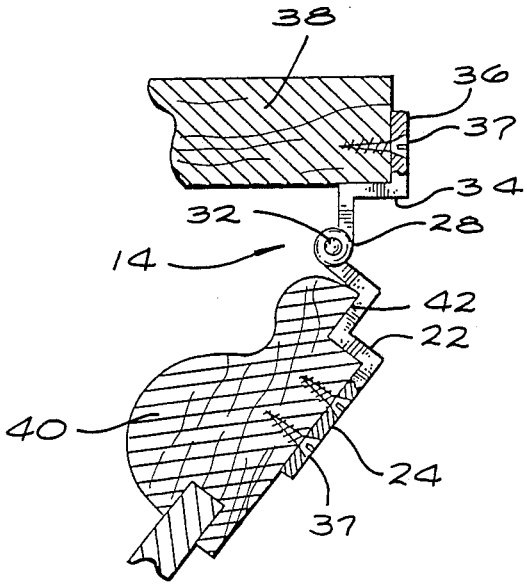
FIG. 3 is a view, partly in section, of the hinge of FIG. 1 as attached to a door and door jamb.
Figure 4:
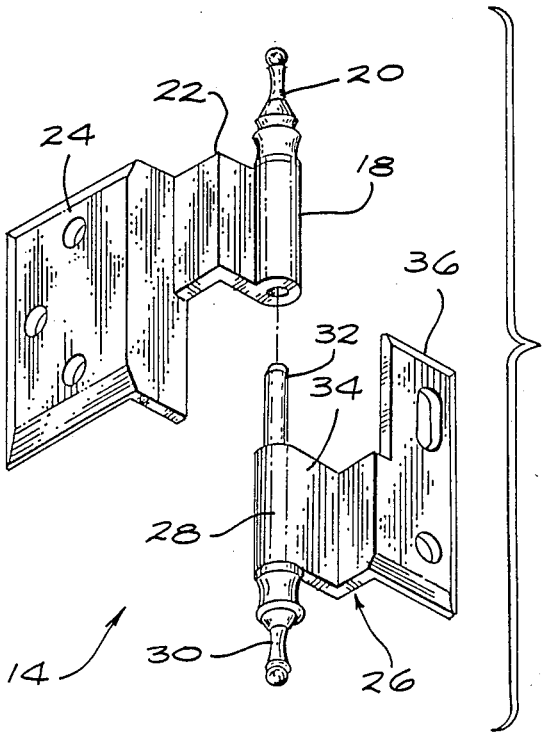
FIG. 4 is an exploded perspective view of the hinge of FIGS. 1–3.

Referring to FIG. 1, a cabinet door 10 is shown mounted in a cabinet 12 and supported on a pair of hinges 14 which are so designed that only the cylindrical pivot structure is visible. Details of this hinge will become apparent from consideration of FIGS. 2, 3 and 4. The hinge structure 14 includes a jamb member 16 having a first hollow cylindrical part 18 which has one end closed and to which is attached a finial 20. A flange structure is tangentially attached to cylindrical part 18 which includes a first offset section 22 of L-shaped cross section which is approximately the same length as the height of cylindrical part 18, and an additional section 24 attached at a right angle to the outboard edge of section 22 and which is approximately twice the height of section 22. Secured in the interior of cylindrical part 18 is a cylindrical pin 19 which is fitted into cylindrical part 28 when the hinge is assembled. The door member 26 also includes a hollow cylindrical part 28 having one closed end to which is attached a finial 30. Tangentially attached to cylindrical part 28 is a support member 34 having an L-shaped cross section and having an L-shaped extension including an elongated flange 36 attached at right angles at its outboard end. The length of flange 36 is approximately twice the height of cylindrical part 28. FIG. 3 shows the door jamb member 16 attached to a jamb 38 and door member 26 fastened to a door 40 formed with an offset by means of screws 37.

A second embodiment is shown in FIGS. 5, 6 and 7 and is designed for use where the door is not offset as shown in FIG. 3 at numeral 42. In this application the hinge structure is almost as unobtrusive as is the first embodiment discussed above. This hinge includes a jamb member 44 having a cylindrical part 46 and a flange 48 attached tangentially to the cylindrical part having an L-shaped cross section, with the outboard part of the flange including an elongated portion 50 which is approximately twice as long as the height of the cylindrical part 46, and which is turned ninety degrees at its line of attachment to flange structure 48. A door member 52 includes a cylindrical part 54, a flange structure 56 having an L-shaped cross section and an elongated portion 58. A pin 60 is secured in the hollow interior of cylindrical part 46 and extends a significant distance such that when parts 44 and 52 are put together, pin 60 is inserted into cylindrical part 54. Finials 62 and 64 are fastened at the closed ends of cylindrical parts 54 and 46 respectively.

The manner of attaching the hinge described above is most clearly shown in FIG. 6 where the door 66 and its jamb 68 are shown in section and the hinge members 44 and 52 partly in section. The flange 48, 50 is fastened to jamb 68 by means of a plurality of screws 70, only one of which is shown. Flange 56, 58 is attached to an edge of door 66 by means of screws 72, one of which is shown. With the members 44 and 52 in the positions shown, the door is open somewhat more than ninety degrees. As the door is moved counter-clockwise, it carries member 56 until it closes against member 44 leaving the hinge parts as shown in FIG. 5.

An additional embodiment of my invention is shown in FIGS. 8 and 9. FIG. 8 is a partial plan view of a hinge structure which includes an elongated rod 76 which is turned to provide a decorative finial 78 and a groove 80 (see FIG. 9). An eye bolt 82 including a long threaded arm with a threaded nut 84 is attached to rod 76 with the eye part located in groove 80 having clearance to permit the eye bolt to rotate freely on the groove, but not permitting axial movement along the rod. Displaced a short distance toward the center of the rod is a flange structure 86 which is rigidly attached to the rod in any suitable manner to provide a mounting means for carrying a door. One such means is to provide a flat on the rod and to provide its flange structure with a mounting surface 88 against the flat which can be pinned or welded to the rod. An intermediate connecting section 90 connects this mounting surface 88 to the flat flange member 86 to which the door 92 is attached. The height of this connecting section may vary depending upon the thickness of the door 92. The eye bolt 82 is fed through a drilled passage in jamb 94. The structure at the upper end of rod 76 is essentially a mirror image of that described and the length of rod 76 between flange members 86 will vary with the height of the door 92. If door 92 were very long (such as over four feet long) a third intermediate flange member 86 and/or eyebolt might be affixed to the center of the rod. With this arrangement, the rather large decorative rod having a finial at each end is prominently displayed along the entire edge of the door.

FIG. 10 and 11 show a simplified version of my hinge useful for doors which incorporates the feature of forming the hinge into two easily separable parts. In this embodiment the cylindrical part 96 is formed of one piece with the flange 100 by cutting the part to size and rolling the cylindric part. It is then notched longitudinally a short distance and the parts rolled inwardly to close the end. A pin 98 is secured within the cylindrical part 96 for attachment to a door jamb. The mating section includes a cylindrical part 102 rolled in a similar manner having a flange 104. Each of the cylindrical parts 96 and 102 are formed as described and are closed at their outboard ends. FIG. 11 is a top view of the hinge of FIG. 10 and shows cylindrical part 102 and flanges 100 and 104. This design is simple but effective because, unlike the usual door hinges, the pin cannot be removed with the door locked.

From the foregoing it will be recognized that I have provided a plurality of hinge designs which are highly functional, convenient to install and use and which may be installed in such a way as to be very pleasing in appearance. Two embodiments are almost invisible with the door closed except for the cylindrical parts. With particular attachment means and decorative features have been shown and described, those skilled in the art will be aware of modification within the scope of the attached claims.

What is claimed is:

1. A hinge assembly for fastening a door to a jamb carrying first and second members, each having a hollow cylindrical part closed at one end and a flange extending from said cylindrical part, said flange including an extension extending in a generally axial direction relative to said cylindrical part by an amount approximately twice the height of said cylindrical part;

a cylindrical pin secured in the hollow interior of one of said cylindrical parts; and means for attaching said first member to a door and said second member to a jamb such that said pin is inserted into the hollow interior of the other of said cylindrical parts whereby said door is supported by and permitted to pivot on said hinge assembly wherein the flange of said first member is offset by means of a support part of L-shaped cross section and the flange of said second member is offset by means of a support part including a portion of L-shaped cross section and an additional flange perpendicular to said flange of said second member, wherein the offset support parts of said flanges are tangentially attached to said cylindrical parts and have approximately the same length as the height of said cylindrical parts and the length of said flanges are approximately twice the height of said cylindrical parts such that said offset support parts are in longitudinal axial alignment when said hinge assembly is positioned for closure of said door against said jamb.

2. A hinge assembly as claimed in claim 1 whereby said first and second members are so arranged that said pin is secured in the cylindrical portion of one of said members to be attached to said jamb permitting said door to be removed from said jamb by lifting said pin out of said door.

3. A hinge assembly for fastening a door to a door jamb of a cabinet comprising first and second members each having a hollow cylindrical part, and a portion having an L-shaped cross section extending tangentially from said cylindrically part, said L-shaped portion having a length approximately the same as the height of said cylindrical part;

said first member also including an extension parallel to the part of said L-shaped portion immediately adjacent said cylindrical part and attached to the outboard edge of the other part of said L-shaped portion, said extension being approximately twice as long as the height of said cylindrical part;

said second member also including an extension of L-shaped cross section attached to the outboard edge of said L-shaped portion, said extension being approximately twice as long as the height of said cylindrical part;

a cylindrical pin secured in the hollow interior of one of said first and second members; and means for attaching said first member to a door and said second member to a door jamb such that said pin is inserted into the hollow cylindrical portion of the other of said members whereby said door is supported by and permitted to pivot on said hinge assembly.

4. A hinge assembly as claimed in claim 3 wherein said tangentially attached L-shaped portions are in longitudinal axial alignment when said hinge assembly is positioned for closure of said door against said jamb.

5. A hinge assembly as claimed in claim 3 wherein each of said cylindrical parts is closed at its outboard end.

6. A hinge assembly as claimed in claim 3 whereby said attaching means includes screw holes in each of said extensions and screws for securing said extensions to said door and said jamb.

7. A hinge assembly for fastening a door to a door jamb of a cabinet comprising an elongated rod having grooves near each end thereof, eye bolts secured to said rod in each of said grooves such that said eye bolt may freely rotate relative to said rod but are secured from axial movement, a plurality of flat sections formed on the surface of said rod inwardly of said grooves;

a plurality of flange members fastened to said flat sections, said flange members each including two parallel flat portions separated by an offset portion attached at right angles to said flat portions; and means for attaching said eyebolts to said door jamb and the outboard parallel portions of said flange members to said door.

8. A hinge assembly as claimed in claim 7 wherein said flange members are formed with said parallel flat portions extending in opposite directions from said offset portions and said outboard portion is drilled to receive screws.

* * * * *